US006860199B2

(12) United States Patent
Lee et al.

(10) Patent No.: US 6,860,199 B2
(45) Date of Patent: Mar. 1, 2005

(54) INK PRINTING APPARATUS FOR COMPENSATING MIS-ALIGNMENT OF PATTERNS CAUSED BY SUBTRATE VARIATION AND PATTERNING METHOD USING THE SAME

(75) Inventors: Hyun-Kyu Lee, Seoul (KR); Myoung-Kee Baek, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 47 days.

(21) Appl. No.: 10/288,420

(22) Filed: Nov. 6, 2002

(65) Prior Publication Data

US 2003/0121429 A1 Jul. 3, 2003

(30) Foreign Application Priority Data

Dec. 28, 2001 (KR) ..... 10-2001-0087433

(51) Int. Cl.[7] ..... B41F 17/14
(52) U.S. Cl. ..... 101/170; 101/215
(58) Field of Search ..... 101/170, 215, 101/158, 154, 163, 155, 157

(56) References Cited

U.S. PATENT DOCUMENTS 4,841,857 A * 6/1989 Hashimura et al. ..... 101/158
5,335,595 A * 8/1994 Yamashita et al. ..... 101/158

FOREIGN PATENT DOCUMENTS

JP 03061539 A * 3/1991 ..... B41F/17/14
JP 07240523 A * 9/1995 ..... H01L/29/786

OTHER PUBLICATIONS

Machine translation of JP 7–240523 to Akimoto et al. from Japanese Patent Office website.*

* cited by examiner

*Primary Examiner*—Daniel J. Colilla
(74) *Attorney, Agent, or Firm*—Birch, Stewart, Kolasch & Birch, LLP

(57) ABSTRACT

A method for patterning includes filling ink in a recess of a cliché corresponding to a position of a pattern which will be formed, transferring the ink onto a surface of a transfer roll by rotating the transfer roll while the transfer roll is contacted to the cliché, detecting variation of the substrate by calculating the area of the substrate on which the ink is transferred, calculating moving speed of the substrate on a basis of the detected variation, and re-transferring the ink on the surface of the transfer roll onto the substrate by rotating the transfer roll when the transfer roll is contacted to the substrate while moving the substrate at the calculated moving speed.

18 Claims, 8 Drawing Sheets

INK PRINTING APPARATUS FOR COMPENSATING MIS-ALIGNMENT OF PATTERNS CAUSED BY SUBTRATE VARIATION AND PATTERNING METHOD USING THE SAME

BACKGROUND OF THE INVENTION

1. Field of the Invention

The invention relates to a patterning method, and particularly, to an ink printing apparatus for compensating mis-alignment of patterns caused by variation of a substrate by compensating the printing of the substrate when the length of the substrate has changed.

2. Description of the Background Art

Display devices, especially flat panel displays such as a liquid crystal display (LCD) are operated by switching an active device such as a thin film transistor (TFT) on the respective pixels. This fashion of switching a display device is called an active matrix operating method. In this active matrix operating method, the active devices are disposed on respective pixels, which are arranged in a matrix form to operate the corresponding pixels.

FIG. 1 shows an active matrix type liquid crystal display device. The liquid crystal display device shown in FIG. 1 is a thin film transistor (TFT) LCD using a thin film transistor as the active device. Each respective pixel of the TFT LCD, on which N×M pixels are disposed in transverse and longitudinal directions, has a gate line 4 through which a scan signal is applied from an outer operational circuit, a data line 6 through which an image signal is applied, and a TFT formed on a crossed area of the gate line 4 and the data line 6. The TFT has a gate electrode 3 connected to the gate line 4, a semiconductor layer 8 formed on the gate electrode 3 and activated according to application of the scan signal to the gate electrode 3, and a source/drain electrode 5 formed on the semiconductor layer 8. On a display area of the pixel 1, a pixel electrode 10 connects to the source/drain electrode 5 for switching a liquid crystal (not shown) by applying an image signal through the source/drain electrode 5 by activating the semiconductor layer 8.

The source/drain electrode 5 of the TFT is electrically connected to the pixel electrode 10 formed in the pixel 1, and displays an image by activating the liquid crystal according the signal being applied to the pixel electrode 10 through the source/drain electrode 5.

In an active matrix type display device such as the LCD described above, the pixel has a size on the order of tens of $\mu$m. Therefore, the active device such as a TFT disposed in the pixel should be formed to be a few $\mu$m. Moreover, as demand for display devices of superior image quality, such as superior image quality high definition TV (HDTV), gradually increases, a greater concentration of pixels are disposed on a screen of same area. Therefore, the active device patterns (including gate line and data line patterns) in the pixel become finer, i.e., smaller in size.

On the other hand, in the conventional fabrication of an active device such as a TFT, patterns or lines of the active device are formed using a photolithographic method requiring an exposure apparatus. However, the exposure apparatus is very expensive so that the resultant fabrication cost increases, and the fabrication process becomes complex. Moreover, the exposure area of the exposure apparatus is limited in photolithographic fabrication of the display device, and the photolithographic process is separately piecemeal performed, after dividing the screen, to fabricate a display device of larger area. Therefore, it is difficult to match the divided areas at a precise location during the piecemeal processing of the divided areas. As a result, productivity lowers due to the numerous repetitions of the photolithographic process.

In order to address the above problems, a method for patterning using gravure offset printing has been recently suggested. The gravure printing method is a printing method which stains an engraved plate with ink, and excess ink is scraped off. Gravure offset printing is used in various fields, including for publishing, for printing on packaging, for printing on cellophane, for printing on vinyl, and for printing on polyethylene. Recent research has attempted to apply the gravure printing method to the manufacture of an active device or to a circuit in the fabrication of a display device.

In the gravure offset printing method, the ink is transferred to the substrate using a transfer roll. Therefore, a larger area display device can be patterned by using a transfer roll corresponding to the size of the display device. Gravure offset printing can be used for patterning various patterns of the display device, for example, the gate line and data line connected to the TFT, the pixel electrode, the metal pattern for the capacitor, and the TFT in the LCD.

FIG. 2 shows a conventional art method of patterning using gravure offset printing.

As shown in FIG. 2A, a recess 22 is formed at a certain position on an engraved plate or on a cliché 20 corresponding to a pattern which will be formed on the substrate. Ink 24 fills the recess 22. The filling of ink 24 into the recess 22 is made by applying the patterning ink 24 for on an upper part of the cliché 20. Then, a doctor blade 28 contacts the cliché 20 to remove excess ink. The ink 24 fills the interior of the recess 22 by the action of the doctor blade 28, and the ink 24 remaining on the surface of the cliché 20 is simultaneously removed.

As shown in FIG. 2B, the ink 24 filling the recess 22 of the cliché 20 is transferred to a surface of a transfer roll 30, which rotates to contact the surface of the cliché 20. The transfer roll 30 is constructed to have the same width as that of the panel of the display device to be fabricated. The transfer roll 30 also has the same diameter as the length of the panel. Therefore, the ink 24 filled in the recess 22 of the cliché 20 is completely transferred onto the circumferential surface of the transfer roll 30 by rotation. After that, as shown in FIG. 2C, the transfer roll 30 is rotated in contact with a processed layer 41 formed on the substrate 40, and the ink 24 transferred on the transfer roll 30 is re-transferred onto the processed layer 41. The re-transferred ink 24 is dried by heating to form an ink pattern 42. At this time, the desired ink pattern 42 can be formed on an entire substrate 40 of the display device using only a single rotation of the transfer roll 30.

FIG. 3 shows a conventional art method of patterning the panel of a display device using the gravure offset printing. As shown in FIG. 3, the cliché 20, in which the ink 24 is filled in the recess 22 thereof, and the substrate 40 are located in the same plane. Although it is not shown in FIG. 3, the cliché 20 and the substrate 40 are affixed to a plate for ink printing, and the transfer roller 30 is installed on a side surface of the plate.

In the above-described printing apparatus, transfer roll 30 rotates and proceeds over the cliché 20. The ink 24 transfers to the circumferential surface of the transfer roll 30. In addition, as the transfer roll 30 continues to rotate and proceeds over the substrate 40, the ink 24 is re-transferred to the substrate 40 to form the ink pattern 42. In the above-described gravure offset printing method, the substrate 40 has substantially the same size as that of the cliché 20, and the substrate 40 is disposed on same plane as that of the cliché 20. The transfer roll 30 is rotated and proceeds from the cliché 20 toward and over the substrate 40 to print the ink pattern. Therefore, the ink pattern can be formed on the substrate having a larger area through simple processing, and the pattern can be formed on a larger area substrate such as a liquid crystal panel by post-processing.

However, the method for patterning using gravure offset printing has some problems. Generally, in order to form the pattern of the display device such as an LCD, the above-described gravure offset printing processes repeats a number of times. Various patterns, for example, the gate line or the gate electrode and the data line, are located on different planes. Therefore, in order to form the gate line and the data line, the printing process must be repeated on their respective planes. In addition, in order to form a metal pattern such as for the gate line and the data line, the printing process should be made after a metal layer is laminated by a sputtering or evaporation process. However, the sputtering or evaporation process is usually conducted at high temperature, and therefore the substrate 40 may expand or contract by the heat processing or cooling processing.

Generally, in the gravure offset printing method, the area of the substrate on which the pattern will be formed is set as nearly identical as the area of the cliché 20 and the circumferential surface of the transfer roll 30. Therefore, the ink pattern 42 is formed on entire substrate 40 by one printing process. However, when the substrate contracts or expands from thermal cycling, the area of the substrate 40 deviates from the area of the cliché 20 or the circumferential surface of the transfer roll 30.

FIG. 4 shows the substrate 40 expanded $\Delta x$ toward the x direction. The substrate 40 enlarges as much as $\Delta x$ greater than the cliché 20 in which the ink 24 is filled. Consequently, the areas of cliché 20 and of the substrate 40 differ from each other, and therefore it is impossible to accurately transfer the ink in the cliché 20 onto the substrate 40 in its actual intended form.

Hereinafter, problems of patterning using gravure offset printing on an expanded or contracted substrate 40 will be described in detail.

FIG. 5 is a view showing problems that arise when the gate line 4 and the data line 6 of an LCD are fabricated by gravure offset printing. In FIG. 5, the extended direction of the gate line 4 is set as the x direction, and the extended direction of the data line 6 is set as the y direction.

On a liquid crystal panel having x×y area, the gate line 4 and the data line 6 are formed. An insulating layer (not shown) is laminated, and a metal layer is formed at high temperature, thereby expanding the liquid crystal panel $\Delta x$ toward the x direction. At this time, the expansion toward the y direction will be ignored for convenience' sake. When an ink pattern for forming the data line is formed on the metal layer by gravure offset printing using the cliché and the transfer roll, the first data line 6 is formed at a precise position since it is a reference for the printing. That is, since the transfer roll is operated after positioning the transfer roll on the first data line forming area, the first data line 6 is formed at precise position, and an interval between the gate electrode 3 and the data line 6 is maintained at a set value d.

When the printing continues by advancing the transfer roll, n gate lines 4 are formed, and intervals between the respective gate lines 4 increase as much as $\Delta x/n$ compared to the original interval. Therefore, when the second data line 6 is formed, the interval between the second data line 6 and the gate electrode 3 is $d+\Delta x/n$, and this interval is mis-aligned. The interval between the third data line and the gate electrode is $d+2\Delta x/n$, and the interval is increases more and more, and the interval between the nth data line and the gate line is $d+\Delta x$.

Generally, the size of pixel in LCD has a magnitude of tens of $\mu$m, and the size of TFT is a few $\mu$m. On the other hand, the liquid crystal panel may expand more than a few $\mu$m by heat processing, although this can vary according to the kind of substrate. Therefore, when mis-alignment is generated between the metal patterns, the TFT can function normally at the transfer roll inlet area (print starting point of the transfer roll) since a fine mis-alignment is generated at the transfer roll inlet area. However, a normally functioning TFT cannot be formed at the transfer roll outlet area (print ending point) since the mis-alignment of $\Delta x$ (a few $\mu$m) is generated at the transfer roll outlet area. Even when the degree of expansion of the liquid crystal panel is larger than the pixel area unit, the nth data line (or source/drain electrode) cannot be formed.

SUMMARY OF THE INVENTION

The invention, in part, provides a printing apparatus for patterning and a method for patterning using the same which is able to distribute pattern mis-alignment caused by variation of a substrate onto the entire substrate evenly so that the mis-alignment can be limited to an acceptable tolerance range, by moving the substrate toward a proceeding direction of a transfer roll or toward the opposite direction when ink is re-transferred on the substrate by contacting and rotating the transfer roll on which ink is transferred on the substrate.

The invention, in part, provides a printing apparatus for patterning and a method for patterning using the same which are able to minimize mis-alignment of patterns by constructing a plurality of transfer rolls which are attached/separated and by attaching or removing an auxiliary roll between the transfer rolls according to variation of the substrate.

The invention, in part, provides a printing apparatus for patterning and a method for patterning using the same which are able to minimize mis-alignment of patterns by making a width of a transfer roll shorter than that of a substrate and by operating the transfer roll so as to overlap when the substrate is contracted.

The invention, in part, provides a printing apparatus for patterning including a transfer roll, on which ink corresponding to a desired pattern is transferred; a substrate onto which the transferred ink is retransferred; a substrate mover on which the substrate is mounted, the substrate mover moving the substrate at the same time as contacting and rotating the transfer roll on the substrate, whereby a variation of the pattern on the substrate is generated; and a cliché including a recess filled with the ink formed on a position corresponding to the pattern, for transferring the ink filled in the recess onto the transfer roll as the transfer roll is contacted and rotated on the cliché.

The substrate mover means can be a belt on which the substrate is mounted, a roller for moving the belt, and a motor driving the roller. In addition, a CCD (charge coupled device) for photographing the image of the substrate is mounted over the substrate on the belt, and transmits the taken image to a controller. Also, the controller measures present substrate size on the basis of the image inputted from the CCD, detects the variation of the substrate by comparing the size to the stored substrate area, and calculates moving speed of the substrate to output a control signal to the motor.

The moving speed (v) of the substrate calculated by the controller is $v=\Delta x/t$ when it is assumed that the variation amount of the substrate is $\Delta x$ and the printing time of the transfer roll is t. If the substrate has expanded from heat processing, the substrate is moved toward the opposite direction of the proceeding direction of the transfer roll. When the substrate has contracted, the substrate is moved toward the proceeding direction of the transfer roll.

The invention, in part, provides a printing apparatus having a cliché including a recess into which ink is filled formed on a position corresponding to a desired pattern, multiple separable transfer rolls, to which the ink filled in the recess of the cliché is transferred, contacted and rotated on the surface of the cliché for re-transferring the ink on a substrate, and multiple auxiliary rolls mounted between the transfer rolls when the substrate has expanded and removed from between the transfer rolls if the substrate has contracted.

The invention, in part, provides a method for patterning, which includes filling ink inside a recess of a cliché corresponding to a position of a pattern which will be formed, printing the ink filled in the recess on a surface of a transfer roll by rotating the transfer roll while contacted to the cliché, detecting a variation amount of the substrate by calculating an area of the substrate on which the ink is transferred, calculating moving speed of the substrate based on the detected variation amount of the substrate, and re-transferring the ink of the transfer roll surface onto the substrate by rotating the transfer roll on the substrate while moving the substrate at the measured moving speed.

The invention, in part, provides a method for patterning which includes filling ink in a recess of a cliché corresponding to a position of pattern which will be formed, printing the ink filled in the recess on surface of transfer rolls by rotating multiple separable transfer rolls including auxiliary rolls therebetween while the transfer rolls are contacted to the cliché, re-transferring the ink on the surface of the transfer rolls onto the substrate by rotating the transfer rolls on the substrate, and the ink is re-transferred on the substrate after mounting the auxiliary rolls between the transfer rolls when the substrate has expanded, and the ink is re-transferred by removing the auxiliary roll between the transfer rolls when the substrate is contracted.

The method, in part, includes a method for patterning which includes filling ink in a recess of a cliché corresponding to a position of a pattern which will be formed; transferring the ink filled in the recess onto a surface of a transfer roll by rotating the transfer roll while the transfer roll is contacted to the cliché, the transfer roll being smaller than the substrate; and re-transferring the ink on the transfer roll onto a substrate by rotating the transfer roll when the transfer roll is contacted to the substrate, the re-transferring being performed a plurality of times such that the transfer roll can be applied to the substrate so that some areas of the substrate can be overlapped when the substrate is contracted.

The foregoing and other objects, features, aspects and advantages of the invention will become more apparent from the following detailed description of the invention when taken in conjunction with the accompanying drawings, which provide further description of the invention, as claimed.

BRIEF DESCRIPTION OF THE DRAWINGS

The accompanying drawings are included to provide a further understanding of the invention. The drawings illustrate embodiments of the invention and together with the description serve to explain the principles of the embodiments of the invention.

DETAILED DESCRIPTION

Advantages of the present invention will become more apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

Reference will now be made in detail to the preferred embodiments of the invention, examples of which are illustrated in the accompanying drawings.

The invention minimizes an error (mis-alignment) between patterns on different layers caused by variations of the substrate (expansion or contraction) when a pattern is formed on a display device such as liquid crystal display using gravure offset printing. According to the invention, the error between patterns on different layers is not removed totally by complex processing, but rather is minimized using a relatively simple method. The reason why mis-alignment is minimized is that a thin film transistor can function normally if the alignment error between a gate electrode and a source/drain electrode is within an acceptable tolerance range.

The substrate may be expanded and contracted toward the x direction and the y direction. Therefore, in the invention, the pattern mis-alignment toward the x direction and y direction is prevented. When the substrate is expanded or contracted towards the x direction (that is, towards the traveling direction of a transfer roll) the error is minimized by moving the substrate towards the x direction together with the advancing transfer roll. In addition, when the substrate is expanded or contracted toward y direction, either multiple transfer rolls used or the pattern is transferred to the substrate repeatedly using one transfer roll to minimize the error.

Hereinafter, the apparatus and method for patterning according to the invention will be described in derail with reference to the accompanying Figures.

Figure 6:
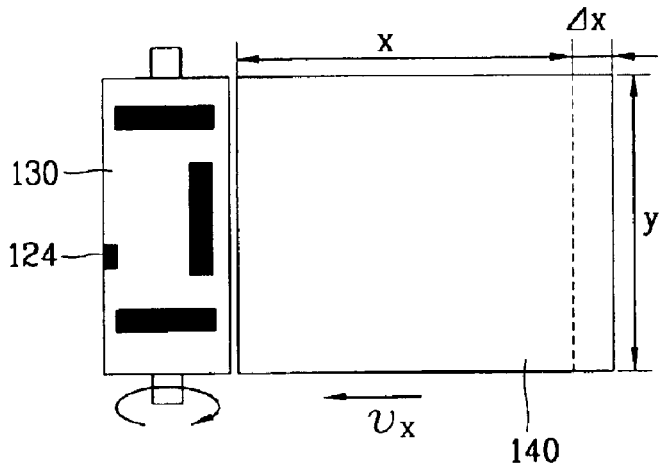
FIG. 6 shows a concept of a gravure offset printing method for minimizing mis-alignment of the pattern when the substrate is expanded toward x direction according to the invention.

FIG. 6 is a view showing a basic concept of the method for patterning according to an embodiment of the invention when a variation of the substrate is generated towards the x direction.

In FIG. 6, the substrate 140 having of x×y area expands as much as Δx toward the x direction. In order to form the pattern using gravure offset printing, the transfer roll 130 on which ink 124 is transferred on a circumferential surface thereof is put onto the substrate 140 to reprint the ink formed on the circumferential surface onto the substrate 140. At the same time, the substrate 140 is moved toward the transfer roll 130 at a speed of $v_x$. At that time, assuming that printing time when the substrate 140 is not expanded is t, the speed ($v_x$) of the substrate 140 is $v_x=\Delta x/t$. As described above, as the substrate 140 is moved toward the transfer roll 130 (−x direction), the transfer roll 130 reprints the ink on the surface thereof all onto the substrate 140 during the time t. On the other hand, when the substrate has contracted, the substrate is moved opposite to the above-described direction (x direction).

Figure 1:
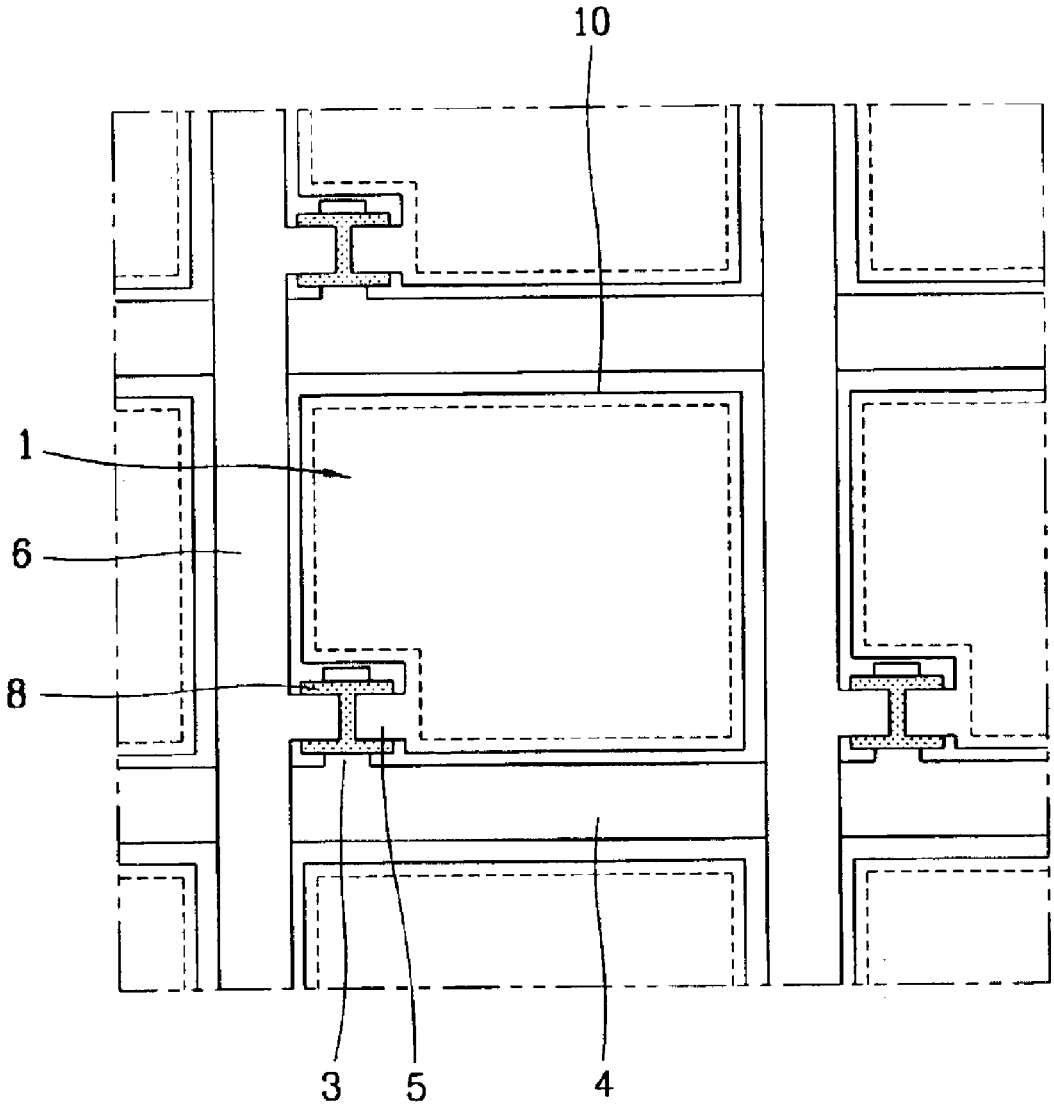
FIG. 1 CONVENTIONAL ART
FIG. 1 is a plan view showing a structure of a general liquid crystal display device.
Figure 2A:
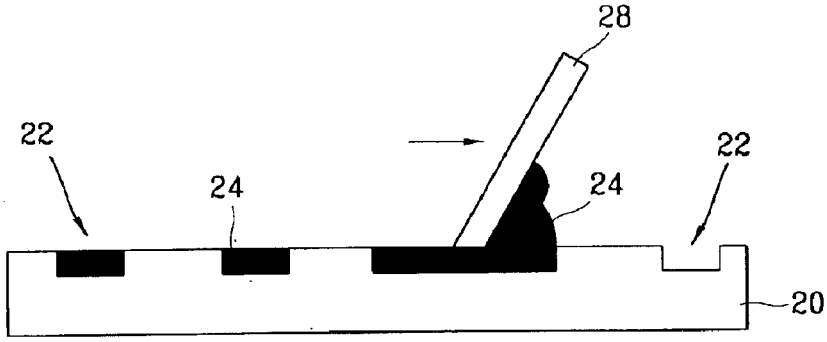
FIG. 2A CONVENTIONAL ART
FIGS. 2A–2C show a method for patterning using conventional art gravure offset printing.
Figure 2B:
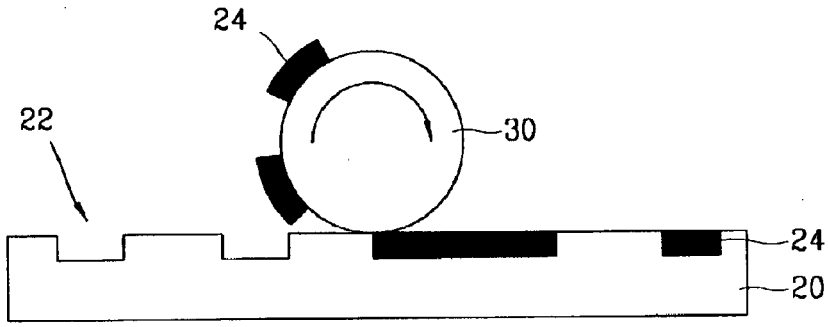
FIG. 2B CONVENTIONAL ART
Figure 2C:
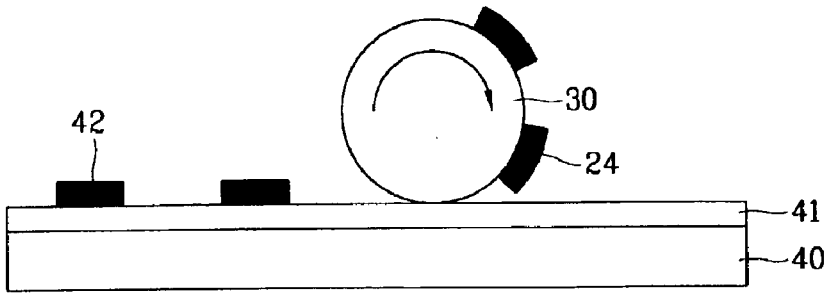
FIG. 2C CONVENTIONAL ART
Figure 3A:
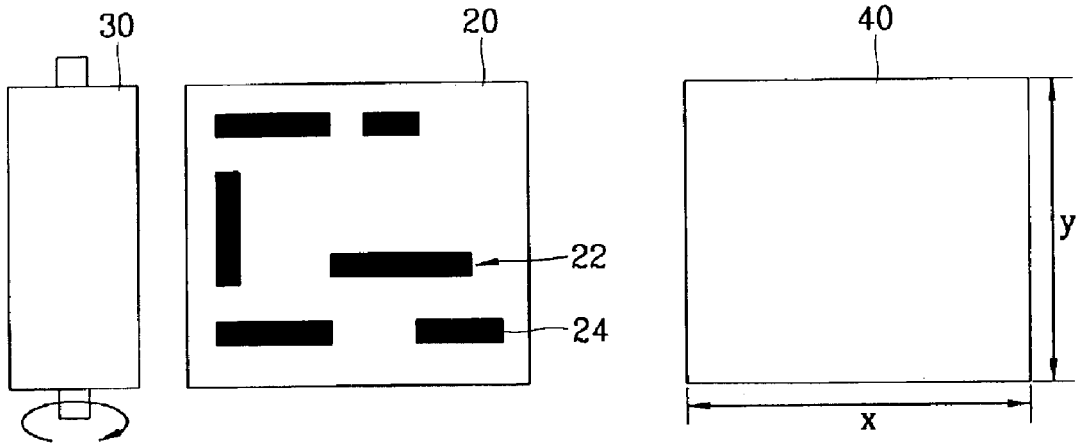
FIG. 3A CONVENTIONAL ART
FIGS. 3A–3B show a method for actual patterning by applying conventional art gravure offset printing.
Figure 3B:
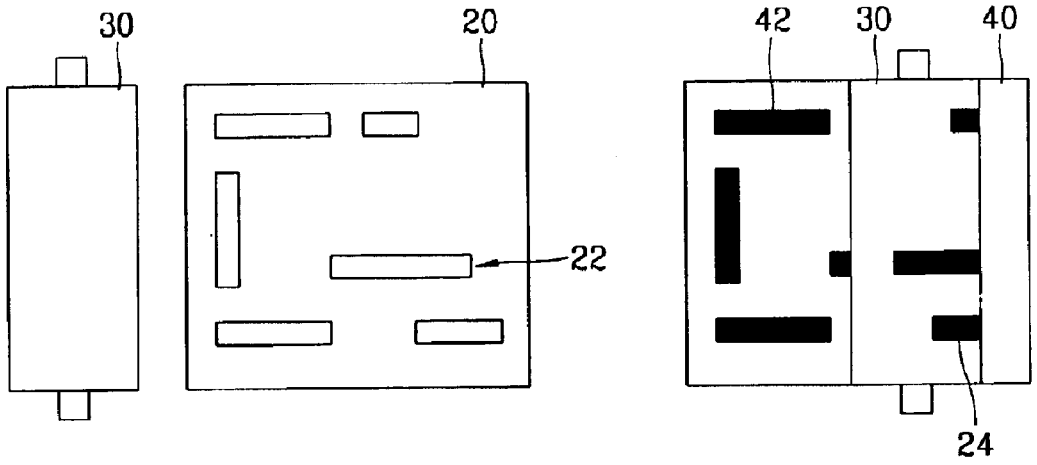
FIG. 3B CONVENTIONAL ART
Figure 4:
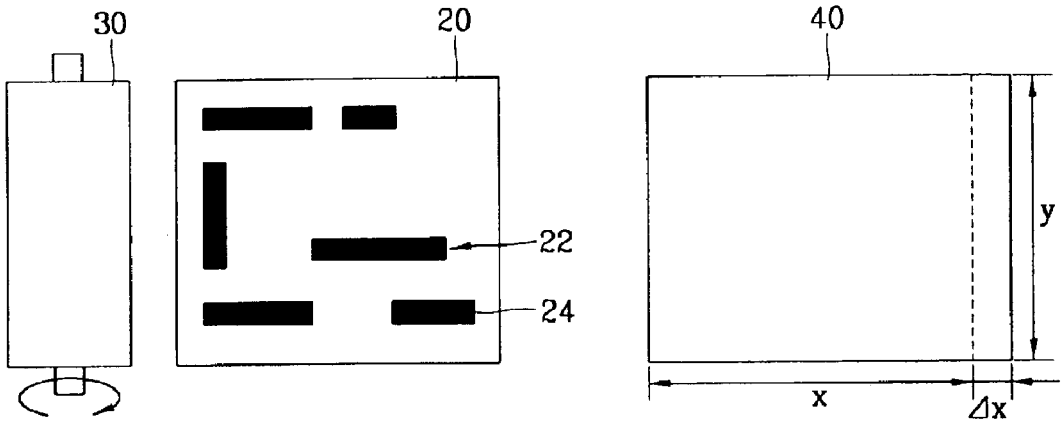
FIG. 4 CONVENTIONAL ART
FIG. 4 is a view showing an expanded substrate.
Figure 5:
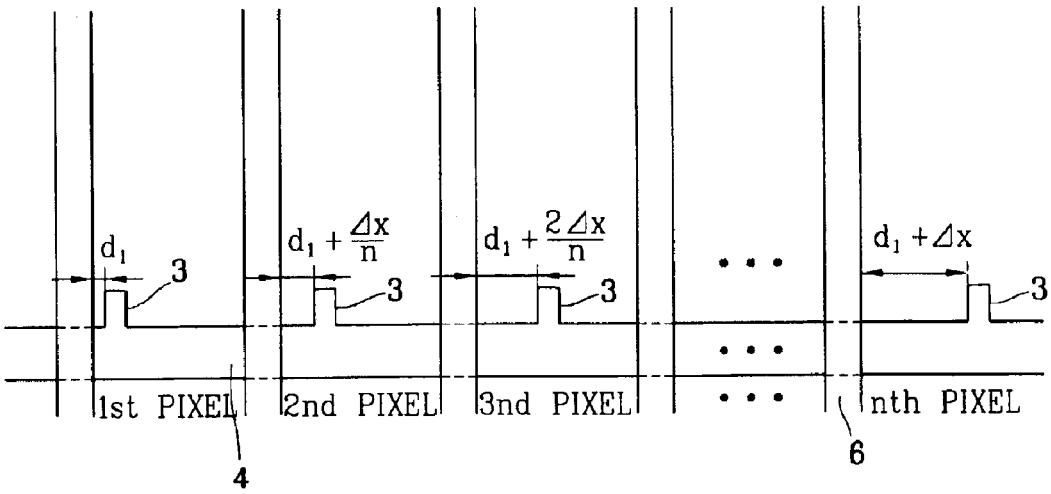
FIG. 5 CONVENTIONAL ART
FIG. 5 is a view showing mis-alignment of a gate line and a data line formed on a panel when the liquid crystal panel is expanded.

In the situation when the gate line, gate electrode, and the data line are misaligned as described in FIG. 5, the substrate 140 is moved and the intervals between data lines are expanded in comparison to the case where the substrate is not expanded. Therefore, the mis-alignment of the gate line and the data line increases gradually going from an inlet (leading) portion toward an outlet (following) portion of the transfer roll 130. However, in the invention, the mis-alignments are distributed evenly over the entire substrate. That is, the variations of the substrate 140 are dispersed throughout the entire substrate, and the variation rate is reduced on any given part (for example, the pixel area). At that time, the mis-alignment of the gate line and the data line on the inlet or the outlet portion of the transfer roll 130 is Δx/X. However, since the error value (Δx/X) has a very small magnitude, even if the error is generated, the operation of the TFT is not affected by the TFT fabrication process.

Figure 7A:
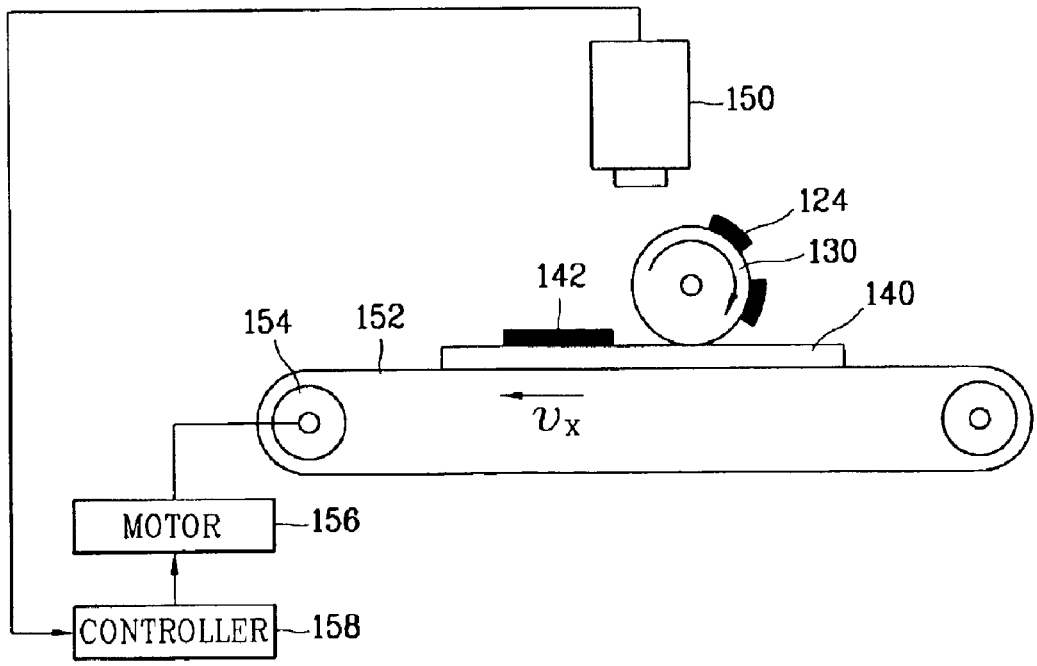
FIGS. 7A–7B show a gravure offset printing apparatus for minimizing mis-alignment of patterns when the substrate is expanded toward x direction according to the invention.
Figure 7B:
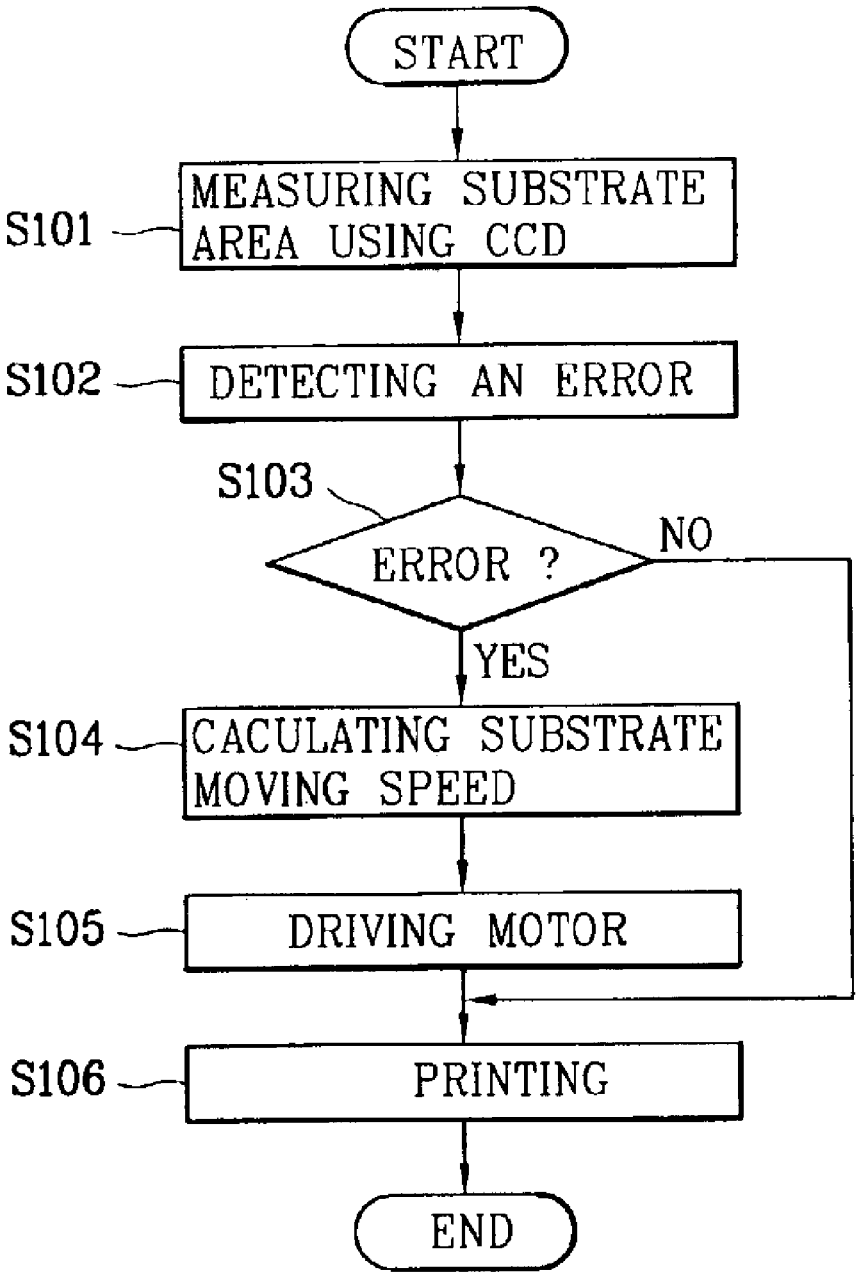

FIG. 7A shows the gravure offset printing apparatus performing the above-described printing, and FIG. 7B shows the gravure offset printing method using the above apparatus. The printing method using the above apparatus will be described as follows in more detail.

As shown in FIGS. 7A and 7B, the substrate 140 is mounted on a belt 152 which moves according to rotations of rollers 154 installed on both sides of the belt 152. The transfer roll 130 contacts and advances on the upper part of the substrate 140, and the ink 124 on the circumferential surface of the transfer roll 130 transfers to the substrate to form an ink pattern 142. Over the upper part of the substrate 140, a charge coupled device (CCD) 150 is mounted. The CCD 150 measures the area of the substrate 140 mounted on the belt 152. The CCD 150 connects to a controller 158 and transmits the image of substrate 140 to the controller 158 as shown in FIG. 7B (S101).

The area of the undistorted substrate (the area before the substrate is expanded or contracted) is stored in the controller 158. The controller 158 detects the area of the present substrate 140 on the basis of the substrate 140 image transmitted from the CCD 150, and determines whether the substrate 140 is expanded or contracted by comparing the detected area with the original area of the substrate and detects any distortion, i.e., error (S102). When the substrate 140 has not expanded or contracted (the case that there is no error), the motor 156 does not operate and the belt 152 stops. Therefore, the ink 124 transfers from the transfer roll 130 under the condition that the substrate 140 is also stopped. When the substrate 140 has contracted or expanded (the case that there is an error), the controller 158 calculates moving speed ($v_x$) of the substrate 140 on the basis of the set printing time and outputs a control signal to the motor 156 (S103 and S104).

The motor 156 operates according to the input of control signal from the controller 158, and the belt 152 moves by the operation of the motor 156 to move the substrate 140 mounted on the belt 152 at the calculated speed $v_x$ (S105). As described above, the transfer roll 130 is rotated while contacting the substrate 140 as the substrate 140 is moved. Therefore, the ink pattern 142 having even mis-alignment throughout the entire substrate 140 can be formed (S106).

Also, when the substrate 140 has contracted, the controller 158 operates the motor 156 in reverse to move the substrate in the opposite direction, and thereby the pattern can be mis-aligned evenly.

As described above, when the substrate has contracted or expanded toward the x direction (gate line direction of the liquid crystal panel or proceeding (advancing) direction of the transfer roll) in the substrate patterning process, the substrate is moved toward the proceeding direction of the transfer roll in the opposite direction to minimize the mis-alignment of the patterns. As the means for moving the substrate, there is the belt on which the roller and the substrate are mounted as shown in FIG. 7A. However, a plate for moving the substrate mounted thereon by a driving engine may be used. In other words, the means for moving the substrate is not limited to a belt, and any appropriate moving means can be used to move the substrate. For example, the substrate 140 can be mounted on a plate and directly advanced by the action of a stepping motor or a motor-driven worm gear.

However, the substrate can not only vary (contract or expand) in the x direction, but can vary in the y direction. Therefore, a method to address the y direction variation is needed.

Figure 8A:
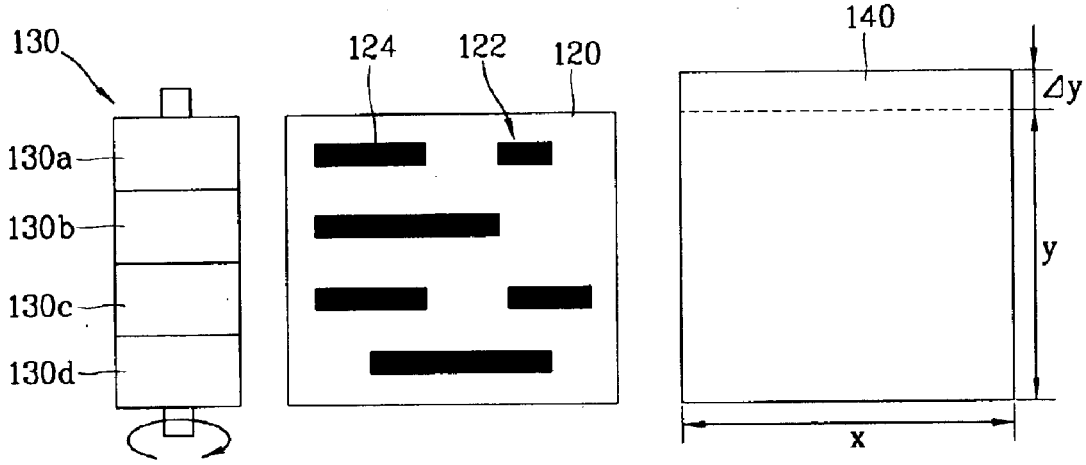
FIGS. 8A–8B show a gravure offset printing method for minimizing mis-alignment of patterns when the substrate is expanded towards the y direction according to the invention.
Figure 8B:
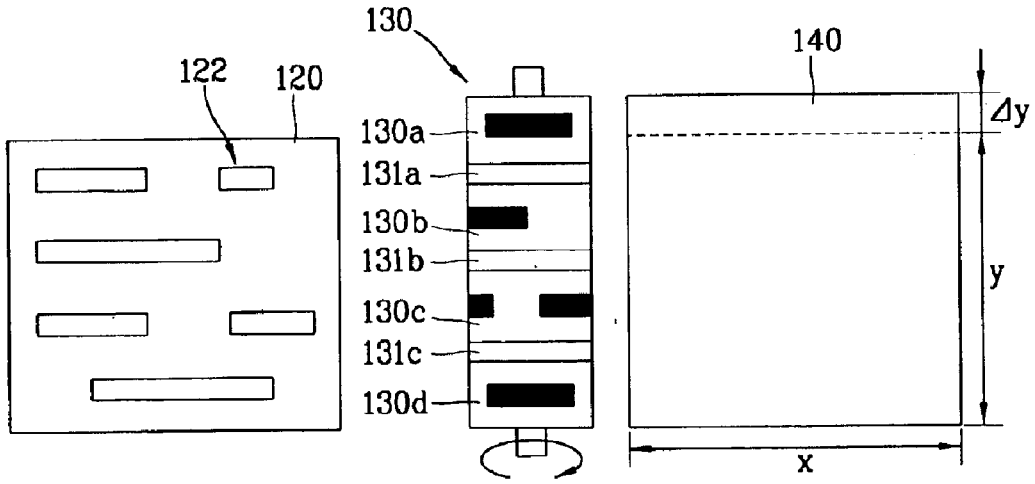
Figure 9:
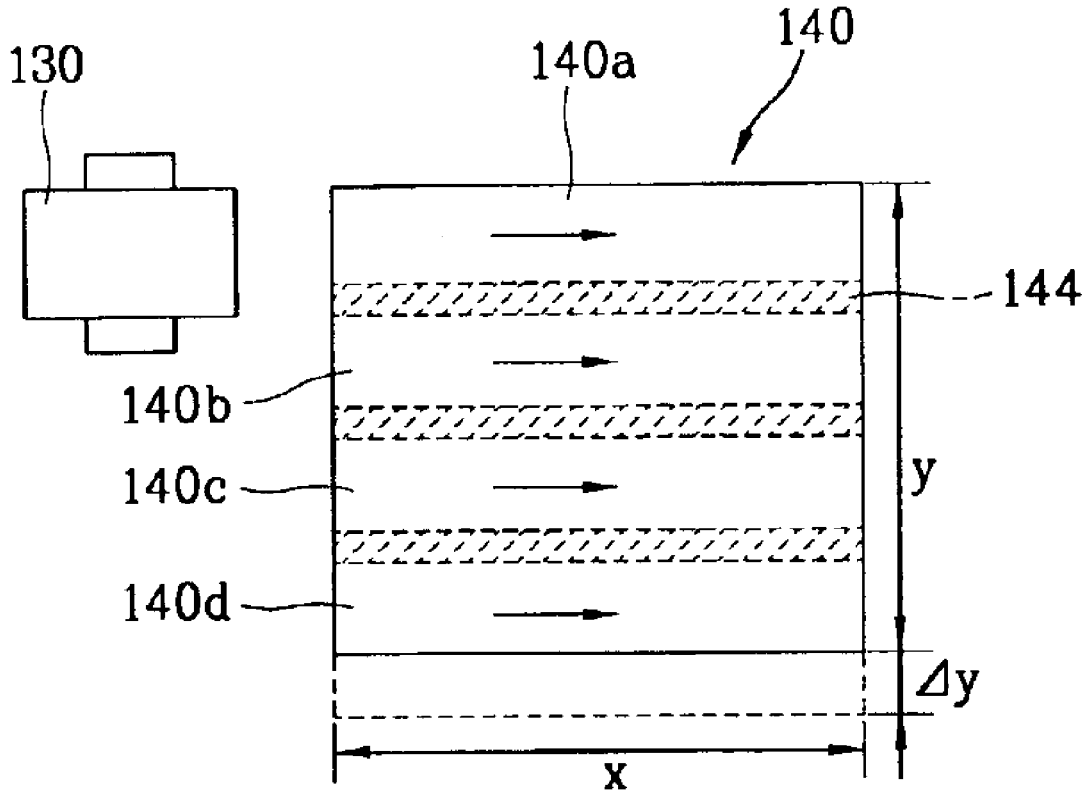
FIG. 9 shows a gravure offset printing method for minimizing mis-alignment of patterns when the substrate is contracted toward the y direction according to the invention.

FIGS. 8A, 8B and 9 show a printing method for when the substrate 140 is contracted or expanded in the y direction.

FIG. 8A shows the case where the substrate 140 has expanded as much as Δy in the y direction. A number of transfer rolls 130*a*, 130*b*, 130*c*, and 130*d* are constructed so as can be attached or separated. The number of transfer rolls is not restricted to four, but any appropriate number of transfer rolls can be used. The transfer rolls 130*a*, 130*b*, 130*c*, and 130*d* are rotated on the cliché 120 in the state that these rolls are coupled, and the ink 124 accordingly transfers onto the respective transfer rolls 130*a*, 130*b*, 130*c*, and 130*d*, as shown in FIG. 8B. Here, the entire width of the transfer roll 130 is y, which is identical to the length of substrate 140 before the substrate 140 has expanded. Therefore, when the transfer roll 130 rotates on the expanded substrate 140 to print the ink 124, a problem similar to that shown in FIG. 5 (the mis-alignment of the pattern is increased on the outlet portion of transfer roll) is generated. Therefore, in the invention, multiple auxiliary rolls 131*a*, 131*b*, and 131*c* having a width as much as the expanded length are attached and coupled between the multiple transfer rolls 130*a*, 130*b*, 130*c*, and 130*d*.

The auxiliary rolls 131*a*, 131*b*, and 131*c* are located between the respective transfer rolls 130*a*, 130*b*, 130*c*, and 130*d*. Therefore, the effects caused by the expansion of the substrate 140 is distributed throughout the entire substrate 140, and the mis-alignment is not concentrated on a pattern formed on a particular area of the substrate 140. Therefore, the mis-alignment of the patterns can be minimized by spreading out the error over the entire substrate 140. The thickness of the auxiliary rolls 131*a*, 131*b*, and 131*c* is $\Delta y/(m-1)$ if it is assumed that the number of the transfer rolls is m. Also, as the number of divisions of the divided transfer rolls 130 increases, the more the mis-alignment can be minimized.

When the substrate 140 is contracted in the y direction, the pattern in which the mis-alignment is minimized can be formed using the above method. In this case, the auxiliary rolls are attached between the multiple transfer rolls 130*a*, 130*b*, 130*c*, and 130*d* in advance (that is, prior to picking up the pattern from the cliché 120), and then the auxiliary rolls corresponding to the contracted length are removed from the entire transfer rolls. As a result, the mis-alignment can be minimized. However, since the auxiliary rolls should be prepared while considering the contracted degree of the substrate (which is difficult to expect in this method), it is difficult to calculate the precise width and number of the auxiliary rolls.

Therefore, when the substrate has contracted, it is preferable that the method shown in FIG. 9 be used. In this method, the transfer roll 130 having a much smaller width than that of the substrate is transferred on the substrate 140 multiple times 140*a*, 140*b*, 140*c* and 140*d* to form the pattern. In this embodiment, the number of transfer passes is not restricted to four, but any appropriate number of passes can be used. This method can be performed because the same patterns are repeated throughout the entire substrate, since multiple pixels are arranged in transverse and longitudinal directions in a display device such as an LCD. Also, the width of the transfer roll 130 may be varied according to the size of the substrate (that is, the panel) and repeated length of the pattern.

When the substrate 140 has not contracted, the substrate 140 is divided into a number of areas having the same width as that of the transfer roll 130, and the ink patterns are formed on the respective areas using the transfer roll 130. On the other hand, when the substrate has contracted, printing is performed by operating the transfer roll 130 so that some of adjacent areas are overlapped. In other words, some of adjacent areas are repeatedly printed. Therefore, the overlapped portions 144 of ink pattern are generated throughout the entire substrate evenly, and excessive mis-alignment on a certain area can be prevented.

As described above, when the substrate is contracted or expanded by heat processing, etc., the ink is transferred while moving the substrate toward the expanded or contracted direction, a plurality of transfer rolls are formed, or a plurality of areas are printed repeatedly using one transfer roll. As a result, concentrated or excessive mis-alignment on the pattern can be prevented. Actually, if an LCD is fabricated by the invention, the patterns formed on the liquid crystal panel such as gate line, gate electrode, data line and source/drain electrode, and pixel electrode are not formed precisely on the original intended positions. The invention disperses the mis-alignment of the patterns caused by the contraction and expansion of the substrate over the entire substrate in order to minimize the mis-alignment of the patterns on a particular area so as to fall below a critical range, and the fabricated LCD operates without any problems. According to the invention, the pattern mis-alignment problem is solved using a simple and cheap apparatus. However, the alternative of forming the pattern on a desired position precisely is technically and economically difficult.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

What is claimed is:

1. An ink printing apparatus for patterning comprising:

a transfer roll, an which ink corresponding to a desired pattern is transferred;

a substrate onto which the transferred ink is retransferred;

a substrate mover on which the substrate is mounted, the substrate mover moving the substrate at the same time as contacting and rotating the transfer roll on the substrate;

means for varying the movement of the substrate depending on a variation of the substrate; and a cliché including a recess filled with the ink formed on a position corresponding to the pattern, for transferring the ink filled in the recess onto the transfer roll as the transfer roll is contacted and rotated on the cliché.

2. The apparatus of claim 1, wherein the means for varying comprises:

a belt on which the substrate is mounted;

a roller for moving the belt; and a motor for driving the roller.

3. The apparatus of claim 2, further comprising:

a charge coupled device (CCD) mounted over the substrate for photographing an image of the substrate; and a controller for measuring an area of the substrate on a basis of an image inputted from the CCD, the controller detecting variation of the substrate by comparing an area of the present substrate to a stored area, calculating a moving speed of the substrate, and outputting a control signal to the motor.

4. The apparatus of claim 1, wherein the means for varying moves the substrate toward an opposite direction of the advancing direction of transfer roll when the substrate is expanded, and moves the substrate toward the advancing direction of the transfer roll when the substrate is contracted.

5. An ink printing apparatus for patterning comprising:

a substrate on which transferred ink is retransferred;

a transfer roll, on which ink corresponding to a desired pattern is transferred, said transfer roll comprising a plurality of transfer rolls which can be attached/separated, a plurality of auxiliary rolls attached between the plurality of transfer rolls when the substrate is expanded, and separated from the rolls when the substrate is contracted;

a substrate mover on which the substrate is mounted, the substrate mover moving the substrate at the same time as contacting and rotating the transfer roll on the substrate, the movement of the substrate being dependent upon a variation of the substrate, and a cliché including a recess filled with the ink formed on a position corresponding to the pattern, for transferring the ink filled in the recess onto the transfer roll as the transfer roll is contacted and rotated on the cliché.

6. An ink printing apparatus for patterning comprising:

a substrate on which transferred ink is retransferred;

a transfer roll, on which ink corresponding to a desired pattern is transferred, said transfer roll having a width smaller than that of the substrate so that some areas contacted with the transfer roll are overlapped when the substrate is contracted;

a substrate mover on which the substrate is mounted, the substrate mover moving the substrate at the same time as contacting and rotating the transfer roll on the substrate, the movement of the substrate being dependent upon a variation of the substrate; and a cliché including a recess filled with the ink formed on a position corresponding to the pattern, for transferring the ink filled in the recess onto the transfer roll as the transfer roll is contacted and rotated on the cliché.

7. The apparatus of claim 6, wherein the substrate mover comprises:

a belt on which the substrate is mounted;

a roller for moving the belt; and a motor for driving the roller.

8. The apparatus of claim 7, further comprising:

a charge coupled device (CCD) mounted over the substrate for photographing an image of the substrate; and a controller for measuring an area of the substrate on a basis of an image inputted from the CCD, the controller detecting variation of the substrate by comparing an area of the present substrate to a stored area, calculating a moving speed of the substrate, and outputting a control signal to the motor.

9. A method for patterning, which comprises:

filling ink in a recess of a cliché corresponding to a position of a pattern which will be formed;

transferring the ink filled in the recess onto a surface of a transfer roll by rotating the transfer roll while the transfer roll is contacted to the cliché;

re-transferring the ink on the transfer roll onto a substrate by rotating the transfer roll when the transfer roll is contacted to the substrate;

moving the substrate at a set speed; and varying said set speed to compensate for a variation of the substrate, the varied set speed being dependent upon the variation of the substrate.

10. The method of claim 9, further comprising the steps of:

detecting variation amount of the substrate by calculating an area of the substrate on which the ink is transferred;

calculating a moving speed of the substrate based on a detected variation amount of the substrate; and re-transferring the ink on the surface of transfer roll onto the substrate by rotating the transfer roll on the substrate while moving the substrate at the calculated moving speed.

11. The method of claim 10, wherein the step of detecting variation amount of the substrate comprises the steps of:

measuring the area of substrate by photographing the substrate using a CCD; and calculating a difference between the measured area of the substrate and a stored original area of substrate by comparing them.

12. The method of claim 9, wherein the width of the transfer roll is smaller than that of the substrate so that a part of the area contacted with the transfer roll being overlapped by rotating the transfer roll in a plurality of times.

13. The method of claim 9, wherein the patterning forms a liquid crystal display.

14. A method for patterning, which comprises:

filling ink in a recess of a cliché corresponding to a position of a pattern which will be formed;

transferring the ink filled in the recess onto a surface of a plurality of transfer rolls, which are able to be attached/separated and include auxiliary rolls between the transfer rolls, while the transfer rolls are contacted to the cliché; and re-transferring the ink on the surface of the transfer rolls onto a substrate by rotating the transfer rolls while the transfer rolls are contacting the substrate, wherein the ink is re-transferred onto the substrate by mounting auxiliary rolls between the plurality of transfer rolls when the substrate is expanded, and re-transferring the ink onto the substrate by removing the auxiliary rolls between the transfer rolls when the substrate is contracted.

15. The method of claim 14, wherein there are four transfer rolls.

16. The method of claim 14, wherein the patterning forms a liquid crystal display.

17. A method for patterning, which comprises:

filling ink in a recess of a cliché corresponding to a position of a pattern which will be formed;

transferring the ink filled in the recess onto a surface of a transfer roll by rotating the transfer roll while the transfer roll is contacted to the cliché, the transfer roll being smaller than the substrate; and re-transferring the ink on the transfer roll onto a substrate by rotating the transfer roll when the transfer roll is contacted to the substrate, the re-transferring being performed a plurality of times such that the transfer roll can be applied to the substrate so that some areas of the substrate can be overlapped when the substrate is contracted.

18. The method of claim 17, wherein the patterning forms a liquid crystal display.

* * * * *